US008693290B2

(12) United States Patent
Sato

(10) Patent No.: US 8,693,290 B2
(45) Date of Patent: Apr. 8, 2014

(54) WRISTWATCH PROVIDED WITH FUNCTION DISPLAY PORTION

(75) Inventor: Junichi Sato, Hino (JP)

(73) Assignee: Casio Computer Co., Ltd., Tokyo (JP)

( * ) Notice: Subject to any disclaimer, the term of this patent is extended or adjusted under 35 U.S.C. 154(b) by 43 days.

(21) Appl. No.: 13/597,844

(22) Filed: Aug. 29, 2012

(65) Prior Publication Data

US 2013/0051193 A1 Feb. 28, 2013

(30) Foreign Application Priority Data

Aug. 30, 2011 (JP) ..... 2011-187339

(51) Int. Cl.

| | |
|---|---|
| ***G04B 19/04*** | (2006.01) |
| ***G04B 19/20*** | (2006.01) |
| ***G04B 25/00*** | (2006.01) |
| ***G04C 10/02*** | (2006.01) |

(52) U.S. Cl.

CPC ..... *G04B 19/04* (2013.01); *G04B 19/046* (2013.01); *G04C 10/02* (2013.01)

USPC ..... 368/80; 368/77; 368/205; 368/223

(58) Field of Classification Search

USPC ..... 368/72–74, 77, 80, 107, 110, 205, 223, 368/228

See application file for complete search history.

(56) References Cited

U.S. PATENT DOCUMENTS

| | | | | |
|---|---|---|---|---|
| 2,305,283 | A * | 12/1942 | Theilkas | 368/44 |
| 3,702,530 | A * | 11/1972 | Besson et al. | 368/35 |
| 4,548,512 | A * | 10/1985 | Erard | 368/15 |
| 5,044,961 | A * | 9/1991 | Bruskewitz | 434/304 |
| 5,889,736 | A * | 3/1999 | Fujita et al. | 368/66 |
| 6,490,230 | B1 * | 12/2002 | Sakuyama et al. | 368/11 |
| 8,144,547 | B2 * | 3/2012 | Plancon et al. | 368/10 |
| 2007/0041277 | A1 * | 2/2007 | Gerber et al. | 368/210 |
| 2009/0059732 | A1 * | 3/2009 | Bracher et al. | 368/190 |
| 2009/0257318 | A1 * | 10/2009 | Hiraya | 368/37 |

FOREIGN PATENT DOCUMENTS

JP 2009-281961 A 12/2009

OTHER PUBLICATIONS

U.S. Appl. No. 13/597,927; First Named Inventor: Junichi Sato; Title: "Dial Plate Structure and Watch"; filed Aug. 29, 2012.

* cited by examiner

*Primary Examiner* — Vit W Miska

(74) *Attorney, Agent, or Firm* — Holtz, Holtz, Goodman & Chick, PC

(57) ABSTRACT

A wristwatch is provided with hand(s) and a disk-shaped indicating member disposed between a first dial and a second dial. The disk-shaped indicating member is structured such that a part of the disk-shaped indicating member is exposed from an opening portion of the first dial and that the disk-shaped indicating member indicates, at a region corresponding to the opening portion, one of a plurality of function display portions SPL, STP and RUN provided on the second dial. The hand(s) and the disk-shaped indicating member rotate about a common driving shaft.

6 Claims, 8 Drawing Sheets

WRISTWATCH PROVIDED WITH FUNCTION DISPLAY PORTION

BACKGROUND OF THE INVENTION

1. Field of the Invention

The present invention relates to a wristwatch.

2. Description of Related Art

A conventional analog wristwatch is disclosed in Patent Document 1 (JP2009-281961A), for example. The wristwatch is provided with a cutout portion formed on an upper (clock) dial, a sub clock hand (function indication member) is rotatably provided between the upper (clock) dial and a lower (clock) dial, a plurality of function indicating portions are formed on the lower (clock) dial such that the function indicating portions are exposed through the cutout portion, and one of the function indicating portions can be pointed by a tip of the sub clock hand.

SUMMARY OF THE INVENTION

An object of the present invention is to provide a wristwatch that a function display portion such as a function dial can be easily recognized and easy to read.

To achieve an object, according to an exemplary embodiment of the present invention, provided is a wristwatch that includes a hand indicating a time, a first dial (upper dial) provided with an opening portion at a predetermined position, a second dial (lower dial) disposed under the first dial and provided with a plurality of function display portions arranged concentrically about a driving shaft of the hand at a position where the function display portions are exposed (visible) from the opening portion, and a disk-shaped indicating member disposed between the first dial and the second dial and provided with a function indicating portion so as to be partially exposed from the opening portion and point to one of the function display portions by being rotated. The hand and the disk-shaped indicating member are structured so as to rotate about the driving shaft.

DETAILED DESCRIPTION OF PREFERRED EMBODIMENTS

A wristwatch according to an exemplary embodiment will be explained with reference to the drawings.

(First Exemplary Embodiment)

Figure 1:
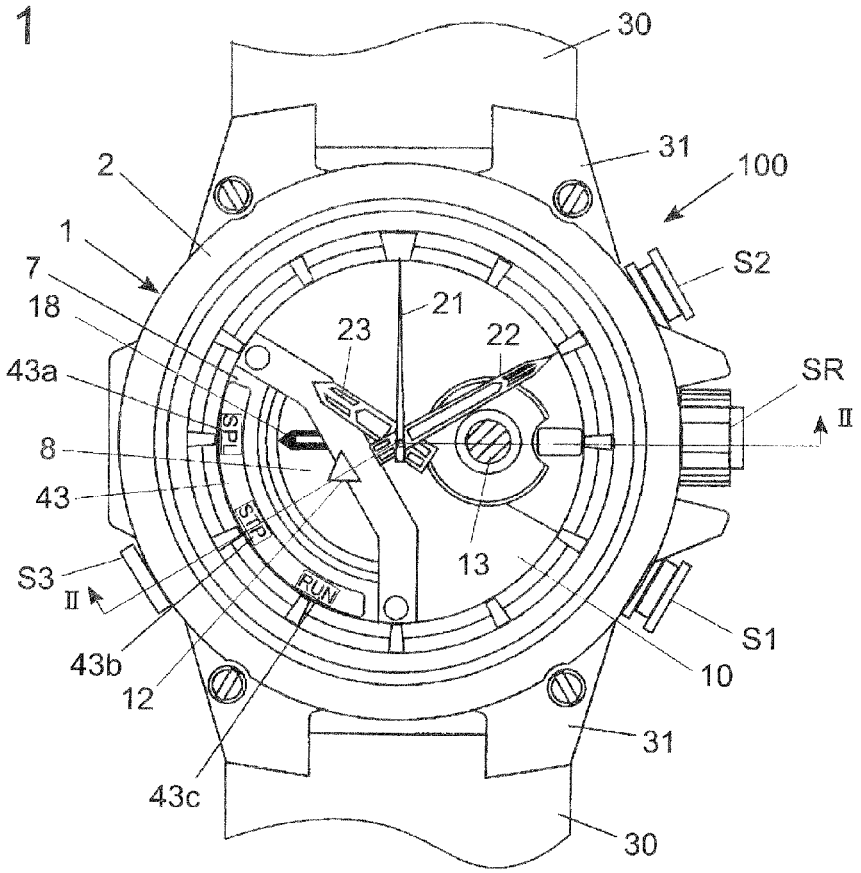
FIG. 1 is a plan view of an analog wristwatch according to an exemplary embodiment of the present invention.
Figure 2:
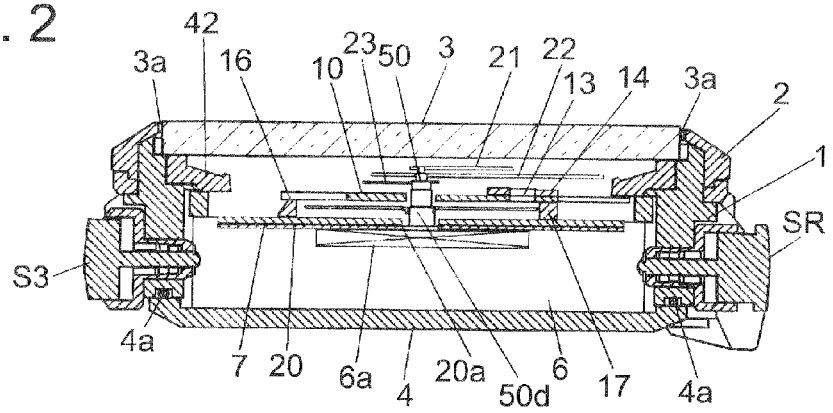
FIG. 2 is a sectional view of the analog wristwatch shown in FIG. 1 along II-II line.

A wristwatch 100 of an exemplary embodiment is an analog wristwatch and includes a wristwatch casing 1 as a main body of the watch as shown in FIGS. 1 and 2.

A bezel 2 is provided on an upper circumference of the wristwatch casing 1. A watch glass 3 is provided at an upper opening of the wristwatch casing 1 and a packing (gasket) 3*a* is interposed between them. A rear lid 4 is provided at a bottom portion of the wristwatch casing 1 between of which a waterproof ring 4*a* is interposed. A watch stem SR and a plurality of press-button switches S1, S2, S3 and the like are provided at a circumferential of the wristwatch casing 1.

Band mounting portions 31, 31 for mounting a wristwatch band 30 are provided at 12 o'clock and 6 o'clock positions of the wristwatch casing 1.

Figure 3:
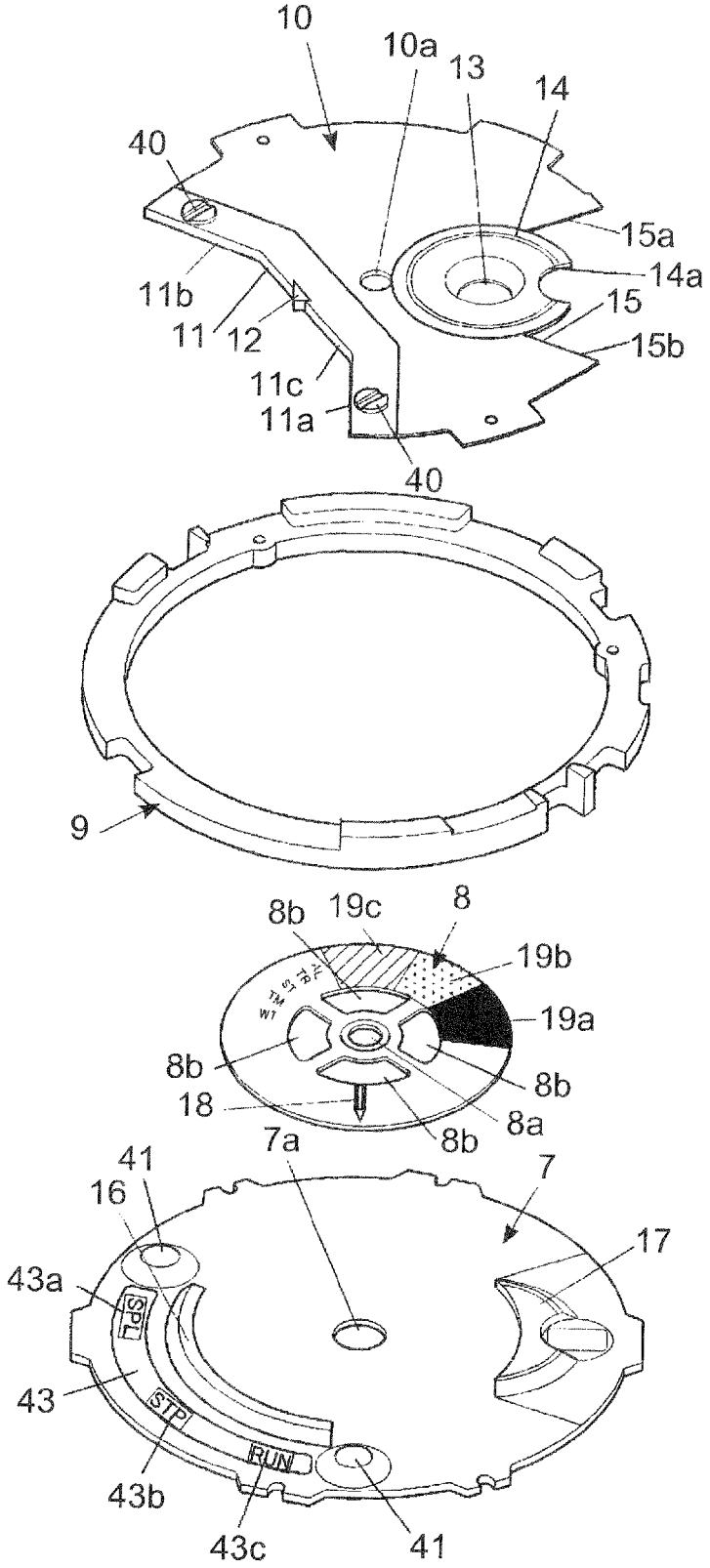
FIG. 3 is an exploded perspective view of the analog wristwatch in FIG. 1 showing an upper (clock) dial, under concealing plate, disk-shaped indicating member and under (clock) dial.

A housing 6 containing a watch module 6*a* and, as shown in FIG. 3, a lower dial (second dial) 7, disk-shaped indicating member 8, lower concealing plate 9 and upper dial (first dial) 10 are provided in the wristwatch casing 1.

The upper dial 10 will be explained at first.

Figure 4:
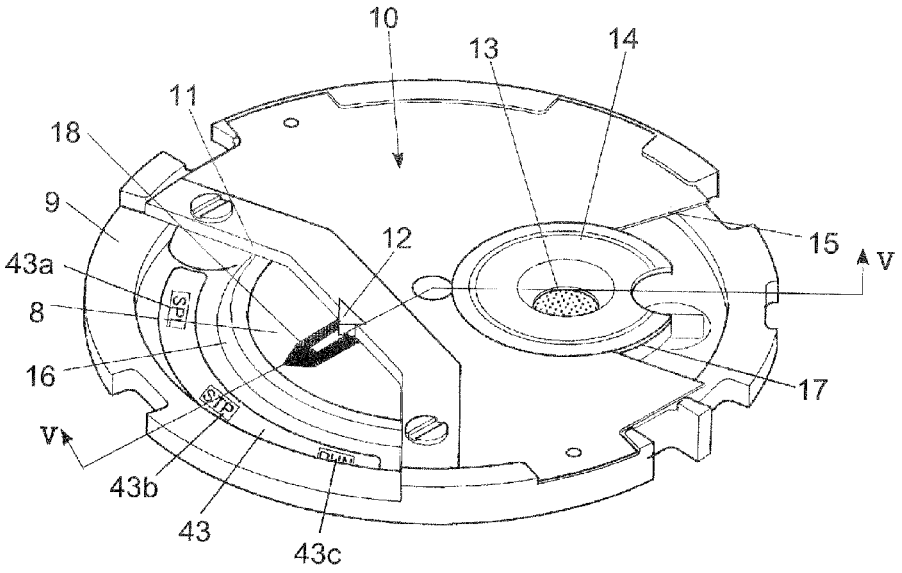
FIG. 4 is a perspective view of an assembled state of the components shown in FIG. 3.
Figure 5:
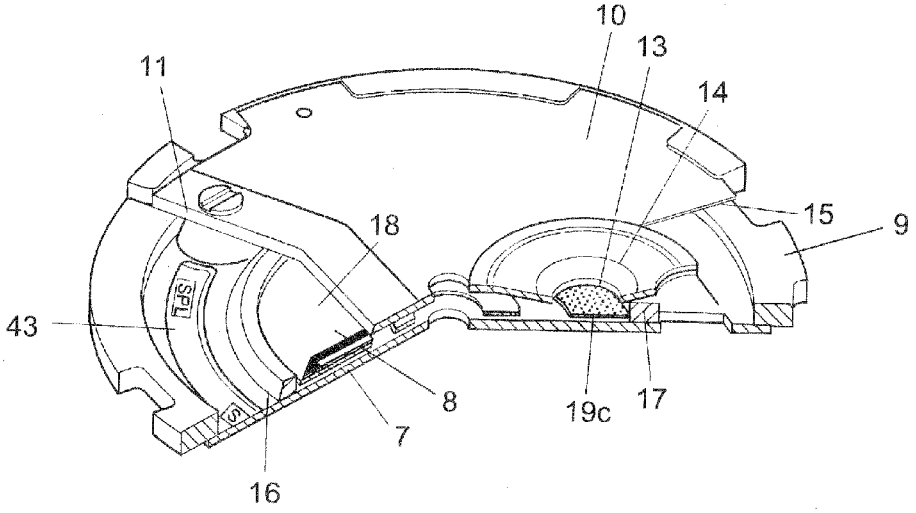
FIG. 5 is a sectional view of the assembly in FIG. 4 along V-V line.

The upper dial 10 is made of a transparent or translucent synthetic resin such as a polycarbonate (PC) or poly-methylmethacrylate (PMMA), for example. The upper dial 10 is perforated to form a shaft insertion hole (perforation) 10*a* as shown in FIGS. 3 to 5. A portion from the 6 o'clock position to the 10 o'clock position of the upper dial 10 is cut out to form a cutout portion (opening portion) 11.

The cutout portion 11 is defined by a side 11*a* which extends from the 6 o'clock position toward the center of the upper dial 10, a side 11*b* which extends from the 10 o'clock position toward the center of the upper dial 10 and a side 11*c* which extends parallel to a diameter of the upper dial 10 and connects the side 11*a* and the side 11*b*.

A (second) function indicating portion (information indicating portion) 12 triangularly protruding in the cutout portion 11 is formed at a center portion of the side 11*c*.

A circular window (second opening portion) 13 is formed in the upper dial 10 at the midpoint between the center of the upper dial 10 and a character which indicates a position of the 3 o'clock.

A circular concealing frame 14, which is piled up from the surface of the upper dial 10, is formed at a circumference of the window 13. The concealing frame 14 is made of, for example, a cupper alloy such as a brass (Bs) or a metal such as aluminum (Al).

Another cutout portion 15 is formed in a rage around the 2 o'clock position to the 4 o'clock position of the upper dial 10.

The cutout portion 15 is defined by a side 15*a* which extends from around the 2 o'clock position toward the center of the upper dial 10 up to the concealing frame 14, a side 15*b* which extends from around the 4 o'clock position toward the center of the upper dial 10 up to the concealing frame 14 and a circumferential edge of the concealing frame 14 which connects the side 15*a* and the side 15*b*.

An additional cutout portion 14*a* that is concaved toward the 3 o'clock position is formed at the concealing frame 14.

An upper concealing member 42 is provided over the upper dial 10. The upper concealing member 42 is provided with characters for clock time and a world time display portion (not shown) around the characters for displaying the times of the world.

Next, the lower concealing plate 9 will be explained.

The lower concealing plate 9 is made of, for example, a cupper alloy such as a brass (Bs) or a metal such as aluminum (Al).

The lower concealing plate 9 is formed in a ring shape. The upper dial 10 is placed on the lower concealing plate 9 and the lower dial 7 is provided under the lower concealing plate 9.

The lower concealing plate 9 is sandwiched between the upper dial 10 and the lower dial 7, and the upper dial 10 and the lower dial 7 are mounted onto the lower concealing plate 9 by screwing a male screw 40 of the upper dial 10 to a female screw 41 of the lower dial 7.

As a result, the lower concealing plate 9 plays a role as a spacer to separate the upper dial 10 and the lower dial 7 in a predetermined distance.

The disk-shaped indicating member 8 is provided between the upper dial 10 and the lower dial 7 that are attached on the lower concealing plate 9.

Next, the lower dial 7 will be explained.

The lower dial 7 is formed in approximately a circle.

The lower dial 7 is made of a transparent or translucent synthetic resin such as a polycarbonate (PC) or poly-methylmethacrylate (PMMA), for example.

A shaft insertion hole (perforation) 7*a* is formed at the center of the lower dial 7.

Concealing frames 16 and 17 are formed on the surface of the lower dial 7.

The concealing frames 16 and 17 are made of, for example, a cupper alloy such as a brass (Bs) or a metal such as aluminum (Al).

The concealing frame 16 is formed in an arc shape concaved toward the center of the lower dial 7.

The concealing frame 16 is formed in an arc shape in a region corresponding to the cutout portion 11 of the upper dial 10 from the side 11*a* to the side 11*b* of the upper dial 10.

An inner circumferential radius of curvature of the concealing frame 16 is slightly larger than that of the disk-shaped indicating member 8.

Figure 6:
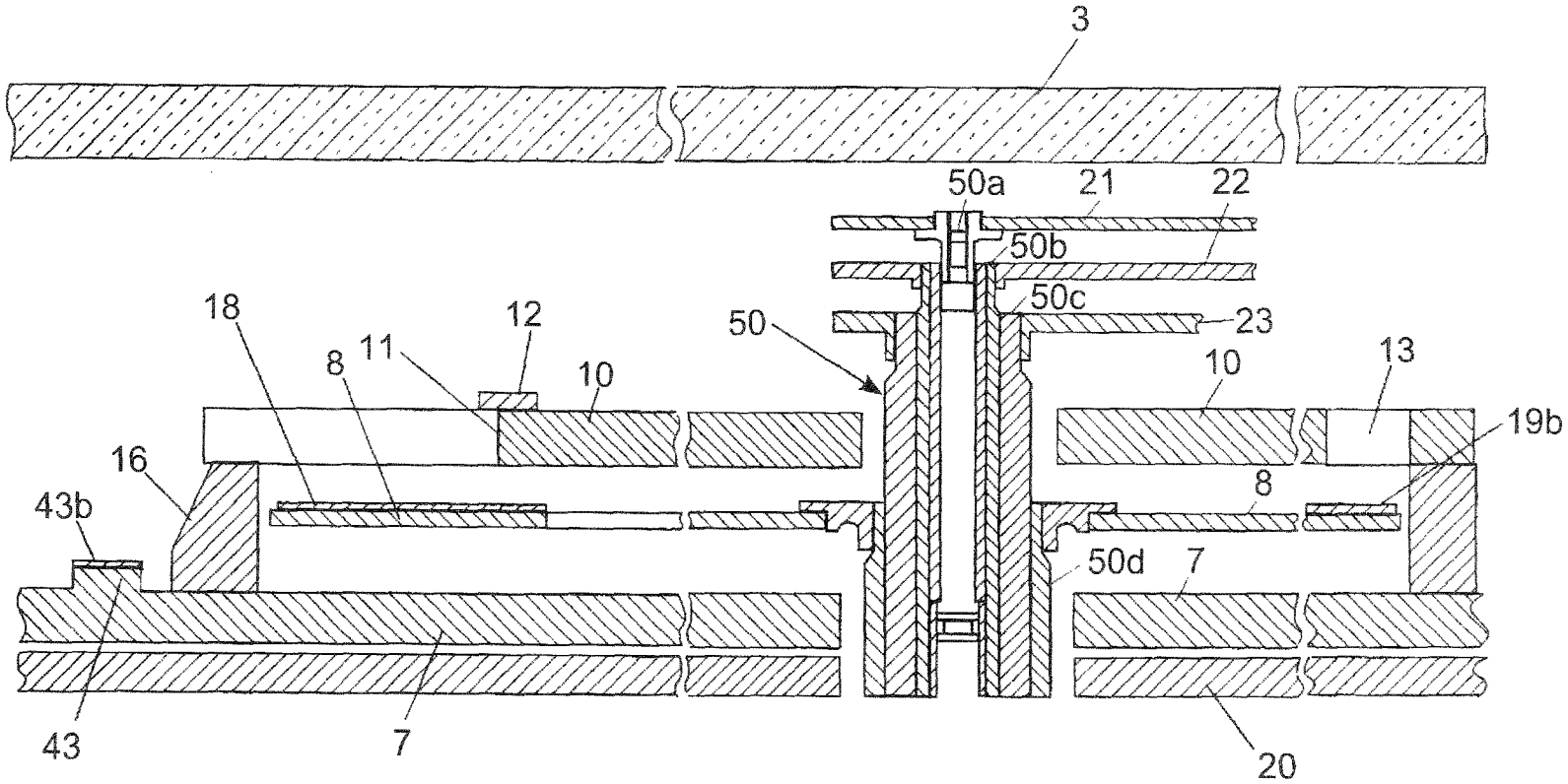
FIG. 6 is a sectional view of a main portion of the analog wristwatch in FIG. 1.

The concealing frame 16 is formed such that the inner circumference opposes an outer circumference of the disk-shaped indicating member 8 as shown in FIG. 6.

The concealing frame 16 functions to keep the outer circumferential surface of the disk-shaped indicating member 8 and a gap between the upper dial 10 and the lower dial 7 being invisible from the watch glass 3 side.

On the other hand the concealing frame 17 is formed in a crescent shape concaved toward the center of the lower dial 7.

The concealing frame 17 is formed under the concealing frame 14 of the upper dial 10.

An inner circumferential radius of curvature of the concealing frame 17 is slightly larger than that of the disk-shaped indicating member 8.

The concealing frame 17 is formed ay a position where the inner circumference opposes the outer circumference of the disk-shaped indicating member 8 and a part of the concealing frame 14 is seated.

The concealing frame 17 is partially cutout at the 3 o'clock position for a window for indicating a date.

The concealing frame 17 functions to keep the outer circumferential surface of the disk-shaped indicating member 8 and the gap between the upper dial 10 and the lower dial 7 being invisible from the watch glass 3 side.

A plurality of function display portions (information display portions) for displaying detailed functions of the stopwatch functions such as "SPL" (function display portion 43*a*), "STP" (function display portion 43*b*) and "RUN" (function display portion 43*c*) are formed at an outer position from the concealing frame 16 in the radial direction on the surface of the lower dial 7.

The plurality of function display portions are arranged along the circumference of the lower dial 7 in predetermined intervals.

The "SPL" means a split display function, the "STP" means a stop function and the "RUN" means an accumulated time clocking function.

The symbol "43" in FIGS. 1 and 3 means a function display region (information display region) on which the plurality of function display portions 43*a* ("SPL"), 43*b* ("STP") and 43*c* ("RUN") are formed.

Next, the disk-shaped indicating member 8 will be explained.

The disk-shaped indicating member 8 is made of aluminum (Al), for example.

A shaft insertion hole 8*a* is perforated at the center of the disk-shaped indicating member 8.

Four fun-shaped sectors (openings) 8*b* are cutout (perforated) outside the shaft insertion hole 8*a* such that a center of the sectors corresponds to the center of the disk-shaped indicating member 8.

The cutout sectors 8*b* play a role to increase the amount of light reaching to a solar panel (cell) 20.

A plurality of (additional) function display portions (information display portions) "TM", "ST", "TR", "AL" and "WT", an arrow-shaped function indicating portion (information indicating portion) 18 and a plurality of fun-shaped indicator portions (information portions) 19*a*, 19*b* and 19*c* are formed on the surface of an outer area of the disk-shaped indicating member 8.

The "TM" means a basic wristwatch function, "ST" means a stopwatch function, "TR" is a timer function, "AL" is an alarm function and "WT" is a world time function.

The indicator portion 19*a* is formed in black color and positioned such that when the arrow-shaped function indicating portion 18 pointed to the "RUN" on the lower dial 7, the indicator portion 19*a* appears in the window 13 of the upper dial 10.

The indicator portion 19*b* is formed in red color and positioned such that when the arrow-shaped function indicating portion 18 pointed to the "STP" on the lower dial 7, the indicator portion 19*b* appears in the window 13 of the upper dial 10.

And the indicator portion 19*c* is formed in blue color and positioned such that when the arrow-shaped function indicating portion 18 pointed to the "SPL" on the lower dial 7, the indicator portion 19*c* appears in the window 13 of the upper dial 10.

The indicator portions 19*a*, 19*b* and 19*c* are not necessarily formed in colors but can be formed by patterns or characters.

As shown in FIG. 2, the solar panel 20 is provided under the lower dial 7 in the wristwatch casing 1.

The solar panel 20 generates electronic power by receiving light through the wristwatch glass 3 from outside and the electronic power is used for charging a secondary battery, for example.

The solar panel 20 has a shaft insertion hole 20*a*.

A hands driving shaft 50, which is connected to a wristwatch movement 6*a*, is inserted into the shaft insertion hole 20*a* of the solar panel 20, the shaft insertion hole 7*a* of the lower dial 7, the shaft insertion hole 8*a* of the disk-shaped indicating member 8 and the shaft insertion hole 10*a* of the upper dial 10 from underside.

A second hand 21, a minute hand 22 and an hour hand 23 are attached at a protruding portion of the hands driving shaft 50 over the upper dial 10.

A function indicating member driving shaft 50*d*, which is connected to the wristwatch movement 6*a* and envelopes the hands driving shaft 50, is inserted into the shaft insertion hole 20*a* of the solar panel 20 and the shaft insertion hole 7*a* of the lower dial 7 from underside.

The disk-shaped indicating member 8 is attached on the driving shaft 50*d*.

The hands driving shaft 50 is structured by a second hand shaft 50*a*, minute hand shaft 50*b*, hour hand shaft 50*c* and the function indicating member driving shaft 50*d* as shown in FIG. 6.

These shafts 50*a*, 50*b*, 50*c* and 50*d* are nested.

The second hand 21 is attached at the top of the second shaft 50*a*, the minute hand 22 is at the minute hand shaft 50*b*, the hour hand 23 is at the hour hand shaft 50*c* and the disk-shaped indicating member 8 is on the function indicating member driving shaft 50*d*, respectively.

In summary, the hands 21, 22 and 23 and the disk-shaped indicating member 8 are structured so as to rotate around the hands driving shaft 50 in common.

Figure 7:
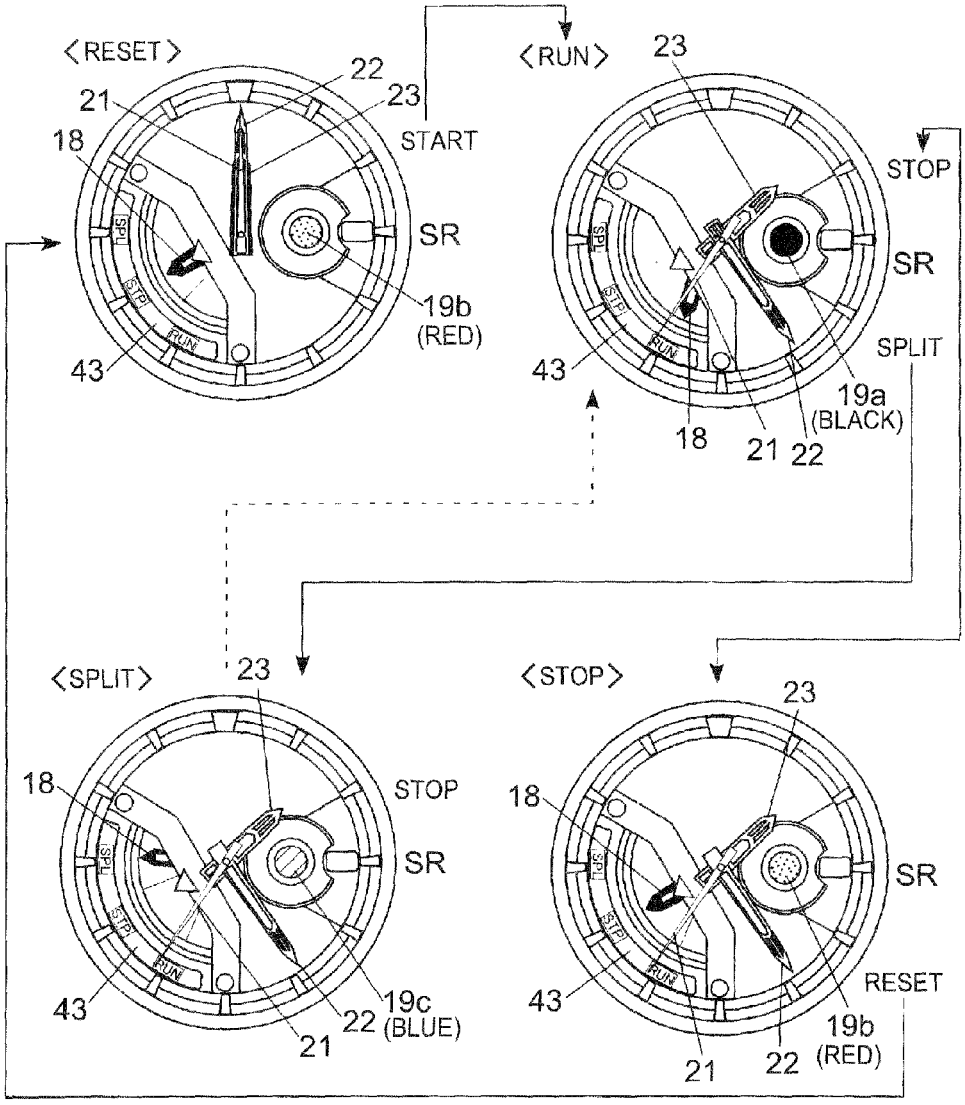
FIG. 7 shows plan views illustrating (clock) dial structures in several states functioned as a stopwatch.

Next, an operation of the wristwatch 100 for function mode change will be explained with reference to FIG. 7.

When the wristwatch 100 is in the basic wristwatch function mode which shows the present time, the disk-shaped indicating member 8 of FIG. 3 rotates at a predetermined angle at each time the watch stem SR shown in FIG. 1 is pressed.

At the same time the function indicating portion 12 of the upper dial 10 points to one of the function display portions ST, TR, AL, WT and TM on the disk-shaped indicating member 8 which rotates at the predetermined angle.

The intended function mode can be set by selecting from the multiple function modes (five modes in this embodiment) ST, TR, AL, WT and TM in this way.

Next, the detailed (sub) function modes of the stopwatch function mode will be explained as an example.

Once the stopwatch function mode is set, the disk-shaped indicating member 8 rotates automatically such that the function indicating portion 18 thereon points to the "STP" on the lower dial 7 and the function display portion 19*b* in red color is exposed (become visible) in the window 13 of the upper dial 10.

And the hands 23, 22 and 21 are directed at 0:0:0 (zero hour, zero minute and zero second position). The state is an initial state ("RESET" state) of the stopwatch function mode.

When the press button S2 shown in FIG. 1 is pressed under this state, the press button S2 functions as a start ("START") switch.

As a result the disk-shaped indicating member 8 rotates, the function indicating portion 18 points to the "RUN" (43*c*) on the lower dial 7 and the function display portion 19*a* in black color is exposed in the window 13 of the upper dial 10.

At the same time the hands 23, 22 and 21 start moving.

When the press button S2 is pressed again in the "RUN" state ("START" state), the press button S2 functions as a stop ("STOP") switch.

As a result the disk-shaped indicating member 8 rotates, the function indicating portion 18 points to the "STP" (43*b*) on the lower dial 7 and the function display portion 19*b* in red color is exposed in the window 13 of the upper dial 10.

At the same time the hands 23, 22 and 21 stop moving.

In this case the hour hand 23, minute hand 22 and second hand 21 represent a minute hand, a second hand a one twentieth second hand, respectively, and thus these hands can indicate a time of lapse (accumulated time) from the point of time the press button S2 is firstly pressed.

The state is the "STOP" state of the stopwatch function mode.

When the press button S1 is pressed in the "STP" state, the press button S1 functions as a reset ("RESET") switch.

As a result, the hands 23, 22 and 21 returns to 0:0:0 while the function indicating portion 18 of the disk-shaped indicating member 8 remains to point to the "STP" (43*b*) on the lower dial 7 and the function display portion 19*b* in red color remains in the window 13 of the upper dial 10.

The function returns to the reset ("RESET") state.

On the other hand, when the press button S1 is pressed after the press button S2 is firstly pressed and the function is in the "RUN" ("START") state, the press button S1 functions as a split ("SPLIT") switch.

As a result the function indicating portion 18 points to the "SPL" (43*a*) on the lower dial 7 and the function display portion 19*c* in blue color is exposed in the window 13 of the upper dial 10.

The hour hand 23, minute hand 22 and second hand 21 represent a minute hand, a second hand a one twentieth second hand, respectively, and thus these hands can indicate a split time (time of lapse from the start point to any point of time).

This is the "SPLIT" state of the stopwatch function mode.

When it is left in this state for five seconds or more, the "SPL" function is automatically canceled and returns to the "RUN" ("START") function.

The function indicating portion 18 points to the "RUN" on the lower dial 7 and the function display portion 19*a* in black color is exposed in the window 13 of the upper dial 10.

The hour hand 23, minute hand 22 and second hand 21 represent a minute hand, a second hand a one twentieth second hand, respectively, and thus these hands can indicate a time of lapse (accumulated time) from the first point of time the press button S2 is firstly pressed.

Following effects can be obtained by the wristwatch 100 of this embodiment.

Because the disk-shaped indicating member 8 is mounted on the common driving shaft 50 for the hands 23, 22 and 21, the radial length of the disk-shaped indicating member 8 can be sufficiently obtained.

Therefore, an area for the function display portions "SPL" (43*a*), "STP" (43*b*) and "RUN" (43*c*) which are pointed by the function indicating portion 18 of the disk-shaped indicating member 8 can be enlarged and thus visibility can be improved.

Because the function display portions "SPL" (43*a*), "STP" (43*b*) and "RUN" (43*c*) are arranged along an arc around the driving shaft 50 as the center of the wristwatch 100, the function display portions becomes easy to read.

In addition, because the disk-shaped indicating member 8 can be enlarged, it becomes easy to form a plurality of function display portions "AL", "TR", "ST", "TM" and "WT".

And it can be structured such that the function display portions "AL", "TR", "ST", "TM" and "WT" are pointed by the function indicating portion 12 on the upper dial 10 and thus variations for function indication can be increased.

Further, because the function display portions "SPL" (43*a*), "STP" (43*b*) and "RUN" (43*c*) are arranged concentrically about the driving shaft 50 of the hands 23, 22 and 21, the portions are easy to read.

In a first embodiment the function display portions "SPL" (43*a*), "STP" (43*b*), "RUN" (43*c*) and the like may be formed at a position nearer to the circumference of the disk-shaped indicating member 8 without forming the concealing frame 16.

It may be also possible to form the function display portions "SPL" (43*a*), "STP" (43*b*), "RUN" (43*c*) and the like on the concealing frame 16.

(Second Exemplary Embodiment)

Figure 8:
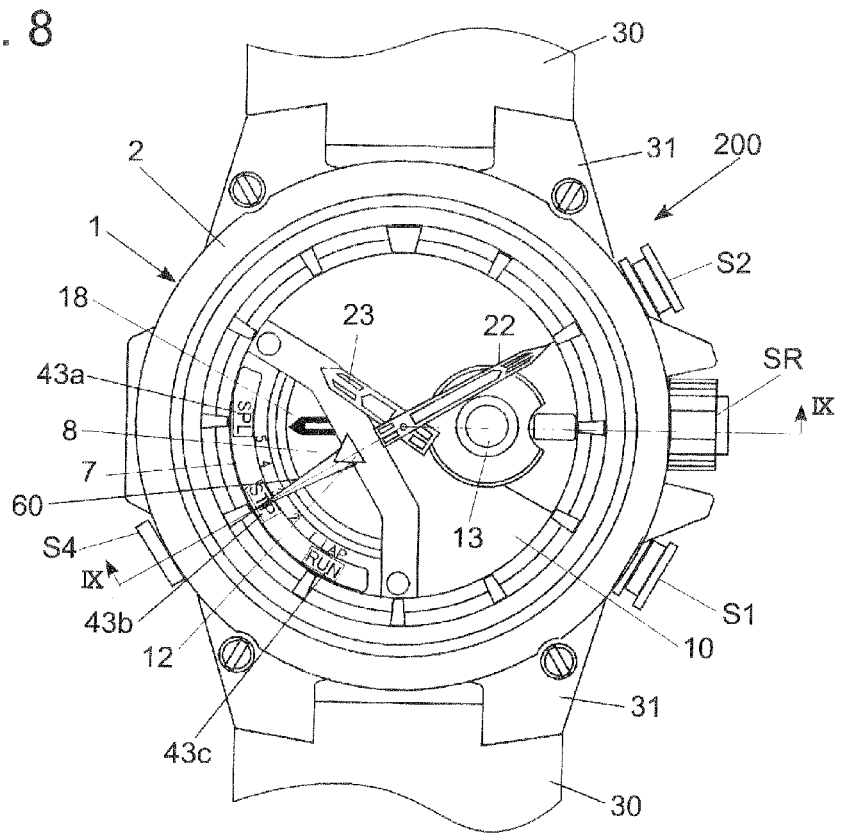
FIG. 8 is a plan view showing an analog wristwatch according to a second exemplary embodiment of the invention.
Figure 9:
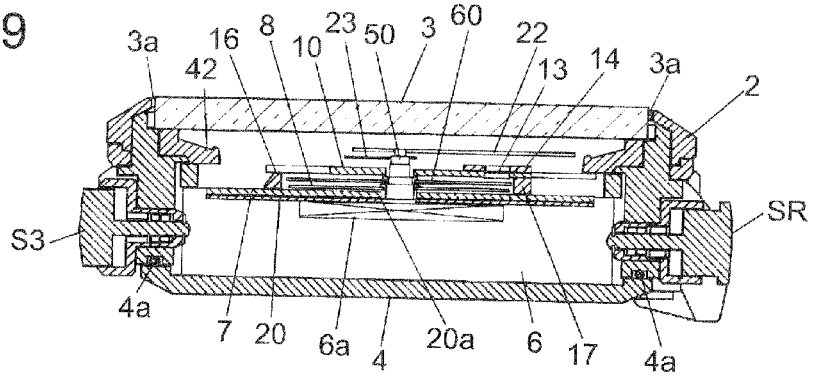
FIG. 9 is a sectional view of the analog wristwatch shown in FIG. 8 along IX-IX line.
Figure 10:
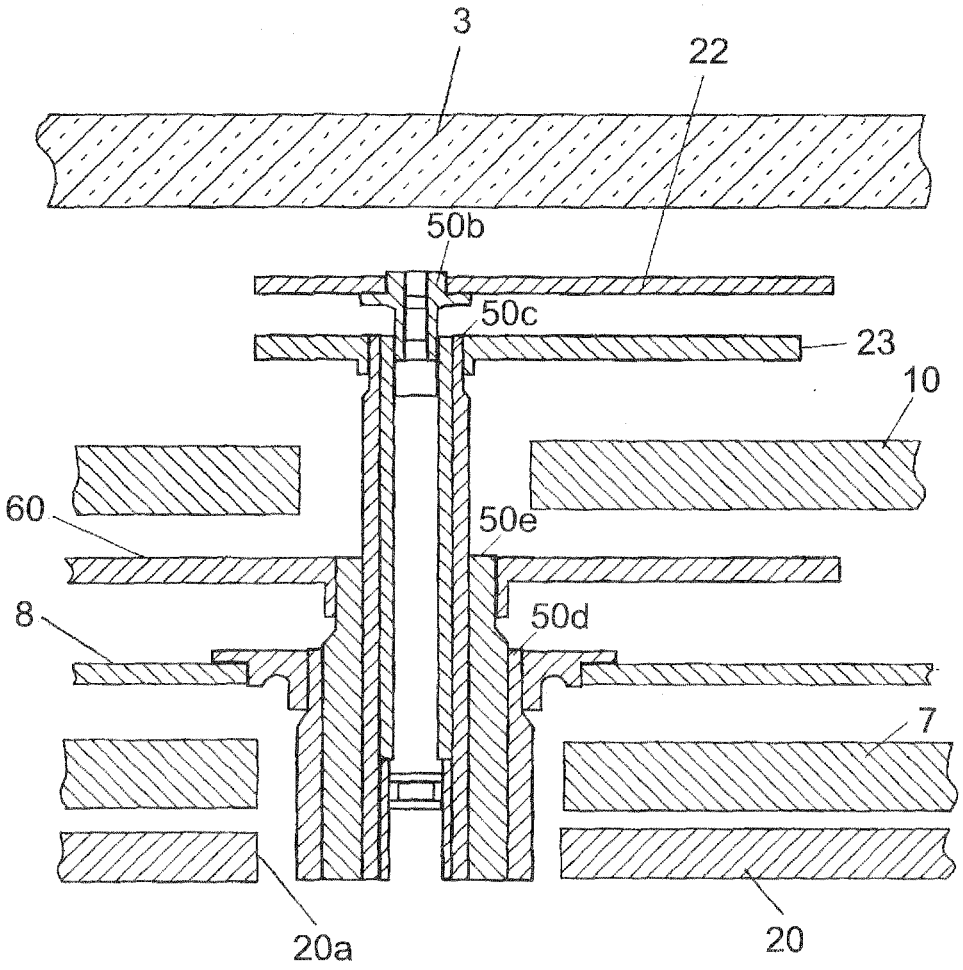
FIG. 10 is a sectional view of the analog wristwatch shown in FIG. 8 around a driving shaft.

FIGS. 8 to 10 illustrate a wristwatch 200 according to another (second) exemplary embodiment of the present invention.

A second embodiment has a similar structure and operation to those of a first embodiment.

Therefore, the same components to those of a first embodiment are designated to the same symbols and further explanations will be omitted.

The wristwatch 200 is an analog wristwatch as a first embodiment.

The wristwatch 200 has a sub-hand (function indicator needle) 60 between the upper dial 10 and the lower dial 7 as well as the disk-shaped indicating member 8.

And another function indicating portions are formed on the lower dial 7 between the function display portions ("SPL" (43*a*), "STP" (43*b*) and "RUN" (43*c*)) and the disk-shaped indicating member 8.

Specifically, the function indicating portions are composed of numeral figures 1 to 5 as the number of laps.

The wristwatch 200 is provided with the driving shaft 50 extending upwardly from the watch module 6*a*. The driving shaft 50 is structured by the minute hand shaft 50*b*, hour hand shaft 50*c*, a sub-hand shaft 50*e* and the function indicating member driving shaft 50*d*.

These shafts 50*b*, 50*c*, 50*e* and 50*d* are nested.

The minute hand 22 is attached at the top of the minute hand shaft 50*b* and the hour hand 23 is attached at the top of the hour hand shaft 50*c*, respectively.

The sub-hand 60 is attached at the sub-hand shaft 50*e* and the disk-shaped indicating member 8 is attached at the function indicating member driving shaft 50*d*.

In summary, the hands 22 and 23, sub-hand 60 and disk-shaped indicating member 8 are structured so as to rotate about the hands driving shaft 50 in common.

According to the wristwatch 200, the sub-hand 60 can indicate the number of laps while the wristwatch 200 is in the split indicating function mode, that is, while the function indicating portion 18 of the disk-shaped indicating member 8 points to the "SPL" (43*a*).

As a result, according to a second embodiment, a user can confirm the number of the laps as well as the split time while the wristwatch 200 is in the split indicating function mode.

The function will be useful to set a pacing when a user takes a jog at a circular course.

In a second embodiment, a second hand 21 is not provided although the hour hand 23 and the minute hand 22 are provided.

However, of course, the second hand 21 may be provided.

(Variation of the Function Indicating Portion of a Second Embodiment)

Figure 11:
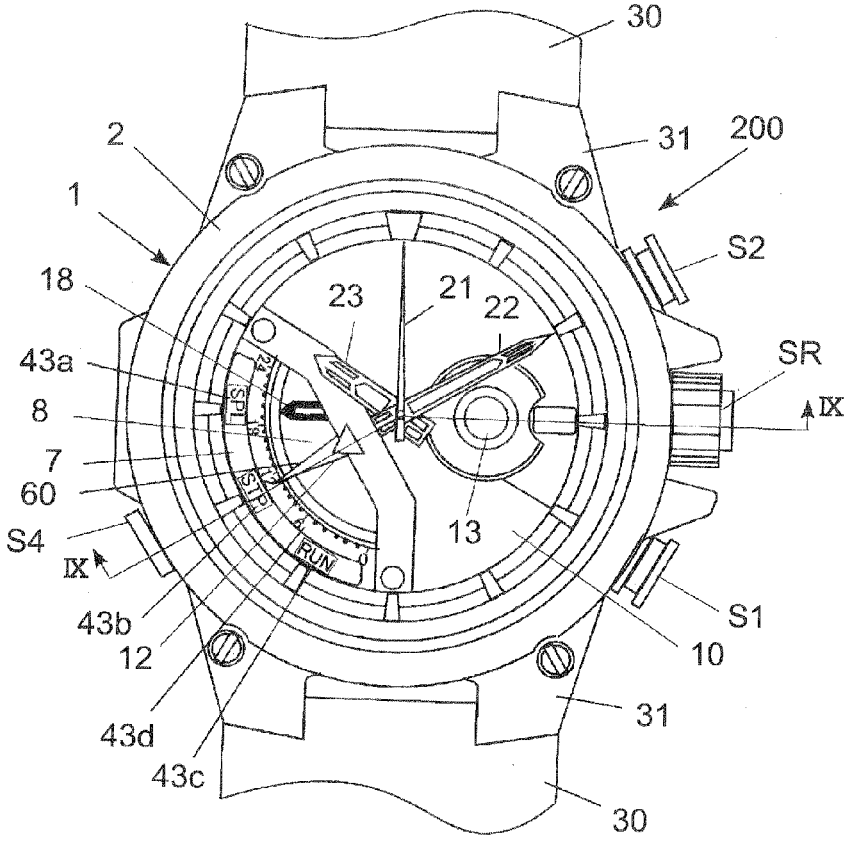
FIG. 11 is a plan view of a wristwatch including a variation of a function display portion of a second embodiment.

FIG. 11 illustrates a first variation of a second embodiment. According to this variation, a circumferential dial portion 43*d* (function display portions) where 0 to 24 characters for indicating time are formed is provided between the function display portions ("SPL" (43*a*), "STP" (43*b*) and "RUN" (43*c*)) and the disk-shaped indicating member 8.

The sub-hand 60 can indicate a time by the circumferential dial portion 43*d* (0-24 hours) at a selected city while the wristwatch 200 is in the world time function mode.

According to the wristwatch of the variation, the sub-hand 60 can indicate the time corresponding to a selected city while the wristwatch 200 is in the world time function mode.

As a result, an approximate world time can be indicated by the sub-hand 60 only without using the hands 23, 22 and 21.

It may be possible that a variation is configured with the minute hand 22 and the second hand 21 that moves on the upper dial 10 and with the sub-hand 60, which is provided between the upper dial 10 and the lower dial 7, as an hour hand 23.

(Variation of the Sub-hand of a Second Embodiment)

Figure 12:
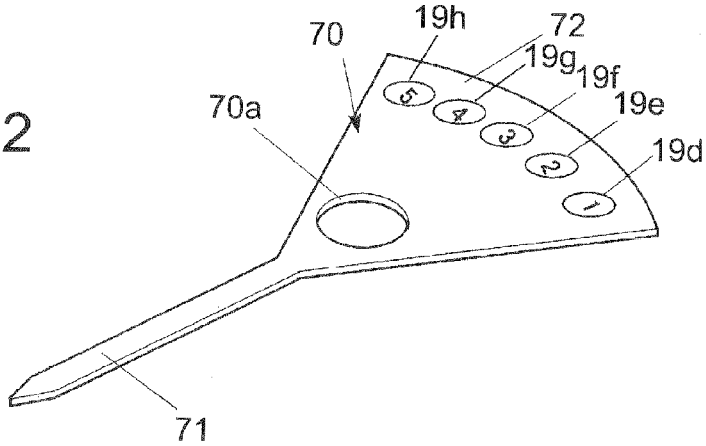
FIG. 12 is a perspective view of a variation of a sub hand of a second embodiment.

FIG. 12 illustrates a variation of the sub-hand of a second embodiment.

A sub-hand 70 of this variation is substituted for the sub-hand 60 of a second embodiment and has a different shape from that.

The sub-hand 70 has a main portion 71 composed of a wedge-shape tip and a strip portion and a sector portion 72 which expands rearward and successively formed at the end of the main portion 71.

A plurality of second indicator portions 19*d* to 19*h* are provided along an arc edge of the sector portion 72.

The second indicator portions 19*d* to 19*h* are five numeral figures (letters) of 1 to 5.

According to this variation, when the sub-hand 70 points to one of the numeral figures 1 to 5 that means the number of laps, the indicator portion of the same numeral figure as the pointed figure is exposed in the window 13.

As a result the number of laps can be easily recognized by the numeral figure exposed in the window 13.

The entire disclosure of Japanese Patent Application No. 2011-187339 filed on Aug. 30, 2011 including specification, claims, drawings and summary are incorporated herein by reference in its entirety.

What is claimed is:

1. A wristwatch comprising:

a hand indicating a time;

a first dial provided with an opening portion at a predetermined position;

a second dial disposed under the first dial and provided with a plurality of function display portions arranged concentrically about a driving shaft of the hand at a position where the function display portions are exposed from the opening portion; and a disk-shaped indicating member disposed between the first dial and the second dial and provided with a function indicating portion so as to be partially exposed from the opening portion and point to one of the function display portions by being rotated; wherein the hand and the disk-shaped indicating member are structured so as to rotate about the driving shaft.

2. The wristwatch according to claim 1, wherein the first dial is provided with a second opening portion at a predetermined position, the function indicating portion is a directing arrow provided on the disk-shaped indicating member, and an indicator portion corresponding to one of the plurality of function display portions is provided on the disk-shaped indicating member such that the indicator portion appears from the second opening portion when the directing arrow indicates to the one of the function display portions on the second dial.

3. The wristwatch according to claim 1, wherein additional function display portions are provided on the disk-shaped indicating member, and a second function indicating portion is provided on the first dial such that the second function indicating portion indicates one of the additional function display portions at an exposed region from the opening portion by rotating the disk-shaped indicating member.

4. The wristwatch according to claim 1, wherein a solar panel is provided under the second dial, and a plurality of fun-shaped sectors are cutout from the disk-shaped indicating member at positions around a center of the disk-shaped indicating member and are not exposed from the opening portion of the first dial.

5. The wristwatch according to claim 1, wherein additional function display portions are provided on the disk-shaped indicating member, a function indicator needle having a tip portion is provided over the disk-shaped indicating member and between the first dial and the second dial, the function indicator needle rotates about the driving shaft and structured such that the tip portion is exposed from the opening of the first dial by a rotation, and the function indicator needle indicates, at an exposed region from the opening portion, one of the function display portions of the second dial or one of the additional function display portions of the disk-shaped indicating member.

6. The wristwatch according to claim 5, wherein the first dial is provided with a second opening portion at a predetermined position, the function indicator needle is provided with a sector portion that is successively formed at an end of the tip portion and expands rearward, and the sector portion is provided with a plurality of second indicator portions that are arranged along an outer arc-shaped circumference and exposed from the second opening portion.

* * * * *